US009528306B2

(12) United States Patent
Wepf

(10) Patent No.: US 9,528,306 B2
(45) Date of Patent: Dec. 27, 2016

(54) LOCKING LATCH FOR YARD DOOR

(71) Applicant: Donald William Wepf, Georgetown (CA)

(72) Inventor: Donald William Wepf, Georgetown (CA)

( * ) Notice: Subject to any disclaimer, the term of this patent is extended or adjusted under 35 U.S.C. 154(b) by 131 days.

(21) Appl. No.: 14/360,334

(22) PCT Filed: Nov. 30, 2012

(86) PCT No.: PCT/CA2012/001098

§ 371 (c)(1),
(2) Date: May 23, 2014

(87) PCT Pub. No.: WO2013/078542

PCT Pub. Date: Jun. 6, 2013

(65) Prior Publication Data

US 2014/0339835 A1 Nov. 20, 2014

(30) Foreign Application Priority Data

Nov. 30, 2011 (GB) ..... 1120625.7

(51) Int. Cl.

| | |
|---|---|
| ***E05C 3/02*** | (2006.01) |
| ***E05C 3/16*** | (2006.01) |
| ***E05B 17/20*** | (2006.01) |
| ***E05B 53/00*** | (2006.01) |
| ***E05B 65/00*** | (2006.01) |
| ***E05C 3/30*** | (2006.01) |

(Continued)

(52) U.S. Cl.

CPC . *E05C 3/16* (2013.01); *E05B 7/00* (2013.01); *E05B 17/2038* (2013.01); *E05B 53/003* (2013.01); *E05B 65/0007* (2013.01); *E05C 3/30* (2013.01); *E05C 19/028* (2013.01); *E05B 13/00* (2013.01); *E05B 13/001* (2013.01); *Y10T 292/1076* (2015.04)

(58) Field of Classification Search

CPC .... E05B 65/0007; E05B 13/001; E05B 13/00; E05C 3/30

USPC ..... 292/230, 231, 233, 235, 236, 238, 337,292/346; 70/63, 135, 137, 256

See application file for complete search history.

(56) References Cited

U.S. PATENT DOCUMENTS 135,396 A * 2/1873 Bishop ..... E05C 1/06 292/143
155,574 A * 10/1874 Duesler ..... E05C 3/124 292/227

(Continued)

FOREIGN PATENT DOCUMENTS

GB 1563295 A * 3/1980 ..... E05B 13/001
GB 2088463 A * 6/1982 ..... E05B 13/001

*Primary Examiner* — Carlos Lugo
(74) *Attorney, Agent, or Firm* — Ridout & Maybee LLP

(57) ABSTRACT

For a gate in a fence, where a person on the street-side cannot access the latch on the yard-side. A lock-assembly is fixed to the gatepost on the street-side, and a latch-assembly is fixed to the yard-side. A cable passes through the gatepost, and connects the assemblies. The latch-assembly is a more-or-less traditional gate latch. The street-side lock-assembly includes a lock-base and a lock-cover, which are relatively openable/closable in a clamshell mode. A combination-lock locks the cover to the base, unlocking the lock-assembly enables a street-side person to open the cover. The opening-movement of the lock-cover is cabled to the latch-lever, unlatching the gate and enabling the gate to open.

11 Claims, 8 Drawing Sheets

(51) Int. Cl.

| | |
|---|---|
| ***E05C 19/02*** | (2006.01) |
| ***E05B 7/00*** | (2006.01) |
| *E05C 3/00* | (2006.01) |
| *E05B 13/00* | (2006.01) |

(56) References Cited

U.S. PATENT DOCUMENTS 2,672,043 A * 3/1954 Folscheid ..... A45C 11/321 109/47
3,146,739 A * 9/1964 Furman ..... A47B 63/00 109/52
3,266,831 A * 8/1966 Banse ..... E05C 3/24 292/133
3,391,256 A * 7/1968 Nawman ..... H04M 17/026 292/167
3,867,823 A * 2/1975 Waltower ..... A45C 11/323 70/456 B
3,888,096 A * 6/1975 Huss ..... E05B 13/001 70/209
4,014,192 A 3/1977 Dillon et al.
4,033,156 A * 7/1977 Cottingham ..... E05B 17/002 174/67
4,044,579 A * 8/1977 Le Bel ..... E05B 13/001 70/416
D333,083 S * 2/1993 Stenger ..... D8/346
5,358,292 A 10/1994 Van Wiebe et al.
5,460,020 A * 10/1995 Hungerford ..... E05B 19/0005 109/53
5,498,041 A * 3/1996 Bezzerides ..... E05B 15/022 292/225
5,655,801 A 8/1997 Casey
5,799,990 A 9/1998 Hardee
6,058,747 A * 5/2000 Doyle ..... E05B 13/105 292/135
6,170,892 B1 1/2001 Lantiegne
6,513,351 B2 * 2/2003 Clark ..... E05B 15/0093 292/127
7,201,030 B2 4/2007 Timothy
7,251,967 B2 * 8/2007 Yang ..... E05B 19/0005 70/25
7,775,564 B2 * 8/2010 Moore ..... E05B 13/001 220/730
7,883,124 B2 * 2/2011 Gephart ..... E05B 65/0007 292/205
8,127,578 B2 * 3/2012 Karcz ..... E05B 65/0007 292/210
8,636,308 B2 * 1/2014 Calamia, III ..... E05B 53/003 292/225
8,764,076 B2 * 7/2014 Glover ..... E05C 3/30 292/225
8,966,947 B2 * 3/2015 Karcz ..... E05B 65/0007 292/210
2010/0123321 A1 5/2010 Timothy et al.
2013/0249221 A1 * 9/2013 Arssinous ..... E05C 1/12 292/173
2015/0292239 A1 * 10/2015 Ng ..... E05B 65/52 70/63

* cited by examiner 49
63
52
58
29
32
34

83A
50
65
61
54
38
56
36
27
30

69
70
72
96
56
32
27

LOCKING LATCH FOR YARD DOOR

This technology relates to gates in fences, and to a locking-latch therefor.

There have been prior proposals for a device that enables locking security for a gate in a fence. The apparatus depicted herein shows an improved cost-effectiveness compared with the previous designs.

The apparatus described herein makes use of a lock-unit, which basically follows the design of lock-unit disclosed in patent publication U.S. Pat. No. 7,251,967 (Yang, 2007). That lock-unit was designed for a padlock, but the design is adapted herein for incorporation into a locking-latch apparatus for a yard gate.

The depicted apparatus includes a latch-assembly which is located on the yard-side of the gate-post, and a lock-assembly which is located on the street-side of the gate-post.

The locking-latch apparatus that is depicted herein is particularly suitable for use with e.g wooden gates that open inwards into the yard. The apparatus enables a person on the street-side of the gate to unlatch and open the gate—provided they know the open-combination of the combination lock of the apparatus. Persons on the yard-side of the gate can unlatch and open the gate without needing to know the open-combination.

Provision of the locking-latch apparatus as described herein would not be so beneficial in the case where the design and structure of the fence and of the gate is such that a person standing on the street-side of the gate could simply reach over the gate, and operate the latch by hand manipulation. Thus, for the apparatus to be beneficial, the gate and fence should be tall enough, and the latch assembly should be so placed, that a person standing on the street-side of the gate and fence cannot reach the latch-assembly fixed to the yard-side of the gate-post.

Generally, a fence around a yard of a house is not roofed in, whereby it is possible for a miscreant to climb over the fence or gate, and gain access to the yard that way. The apparatus depicted herein is not effective against persons who are so determined to gain entry. However, the problems associated with previous devices for putting a look on a yard door/gate do not lie so much in the fact that the security is not absolute, but rather in the fact that the devices have been difficult to install and to operate, and required users to remember a sequence of procedures (in addition to the open-combination), and were difficult or impossible to re-set. Also, some previous devices have been electronic, and required batteries etc. Being exposed to the elements, some previous devices have been adversely affected by the weather, and by corrosion and dirt build-up.

It is an aim of the present design to provide a locking-latch apparatus that is of a simple mechanical nature, and is simple—and indeed is (almost) foolproof—to install, and to operate over a long service period. Preferably, the apparatus is so designed that a person (who knows the combination) can pass through the gate, from the street-side to the yard-side, simply upon operating the apparatus with one hand, and simply pushing the gate open and then pushing it closed, and can thereby leave the now-closed gate securely re-locked. Preferably, the apparatus is so designed that a person on the yard-side can unlatch the gate and can pass through the gate to the street-side, and can walk away and leave the gate securely re-locked, even if the person does not know the open-combination.

It is an aim to enable the assembly, as a saleable product, to fit most types of gate (conveniently, the gate should be of the kind that opens inwards, i.e towards the yard), although the gate (and the fence) preferably should be of a structure such that a person cannot operate the latch simply by reaching through the structure of the gate, to operate the latch. It is an aim of the design, to enable the apparatus to be used with any thickens of gatepost.

LIST OF THE DRAWINGS

Figure 1:
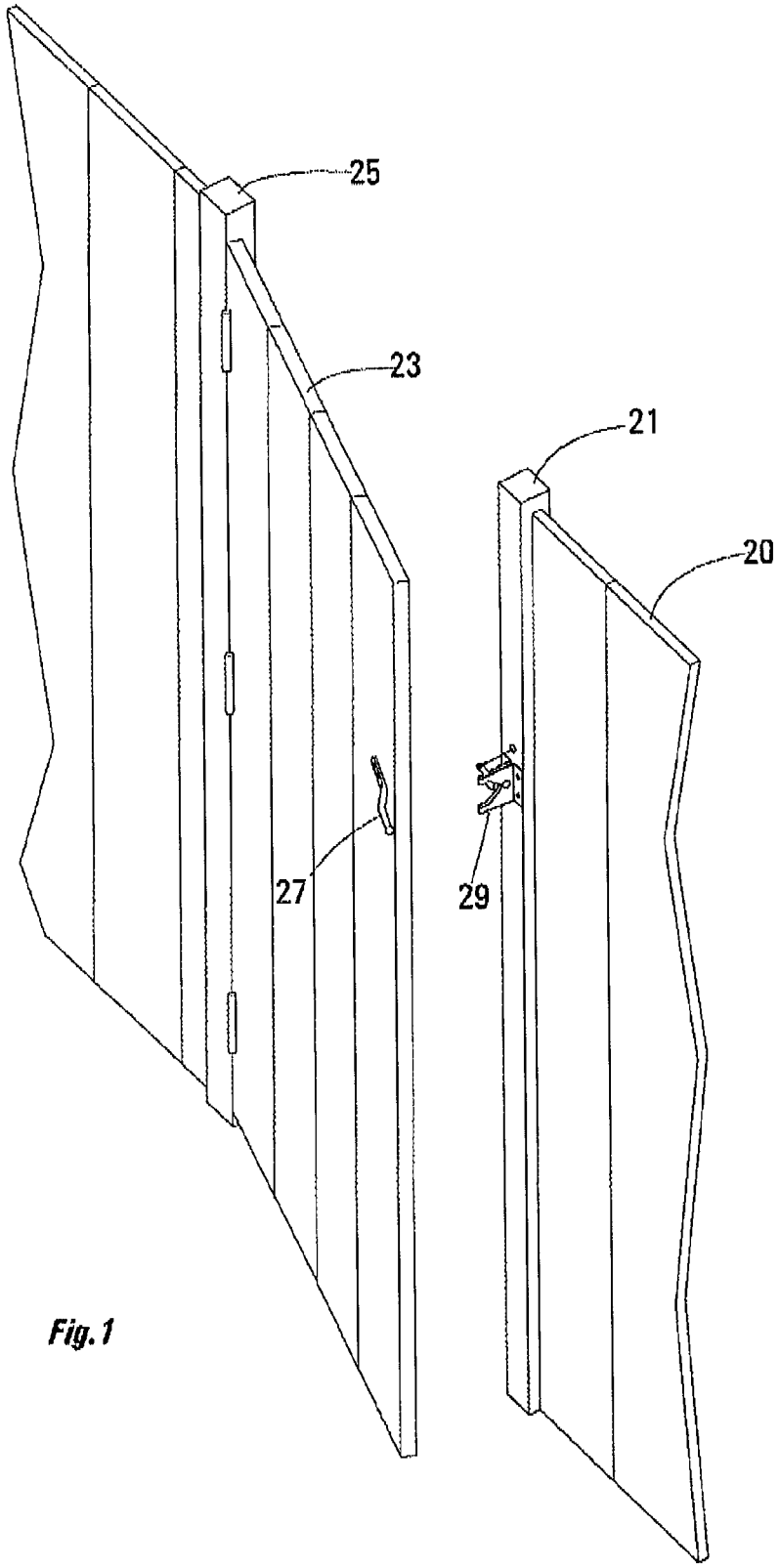
FIG. 1 is a view of a fence, with gateposts, and of a gate in the fence. A locking-latch apparatus is provided for locking the gate, a latch-assembly of which is visible in FIG. 1.

In FIG. 1, a latch-post 21 of a fence 20 is fixed into the ground. The street-side of the fence 20 lies to the upper-right in FIG. 1, and the yard-side to the lower-left. A door or gate 23 is hinged to a hinge-post 25. The gate 23 is provided with a latch-bar 27, which, when the gate is closed, engages a latch-assembly 29 fixed to the latch-post 21.

The latch-assembly 29 is of a more or less traditional design. The latch-assembly 29 includes a latch-frame 30, which is firmly secured to the latch-gatepost 21, e.g by wood-screws. The latch-assembly 29 includes also a latch-lever 32. The latch-lever 32 is mounted in the latch-frame 30, where it can undergo relative pivoting movement about a latch-pivot 34. The latch-lever 32 is formed with a hook 36. The hook 36 has a sloping outer-face 43.

In the latched-position (FIG. 2A) of the latch-lever 32, the hook 36 of the latch-lever 32 blocks the latch-bar 27 from moving to the right, and thereby opening the gate. When the latch-assembly 29 is in its clear-position (FIG. 2C), now the latch-lever 32 is clear of the latch-bar 27, and the latch-bar is free to move to the right, out of the latch-frame 30, and the gate is open.

The gate 23 (being closed) can be opened in the traditional manner by a person on the yard-side of the fence. That is to say; the person on the yard-side manually presses the latch-lever 32 upwards and towards the latch-post 21, towards the FIG. 2C clear-position; at that, the latch-bar 27 is now clear to be disengaged from the latch-assembly 29, and the person can pull the gate 23 open.

The traditional gate latch is of such design that, the gate being open, and upon being closed by a person, the gate will latch closed automatically. This happens whether the person closing the gate is on the yard-side of the fence or on the street-side.

Figure 2A:
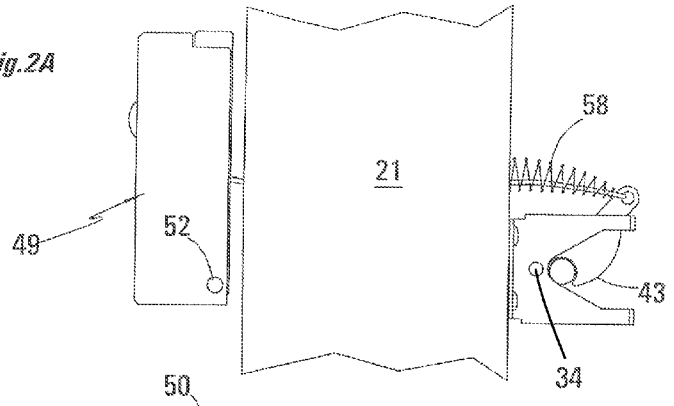
FIG. 2A shows the latch-gatepost, and includes a side elevation of the locking-latch apparatus, including components thereof on the street-side of the fence and components on the yard-side. The apparatus is shown in its closed-latched position.
Figure 2B:
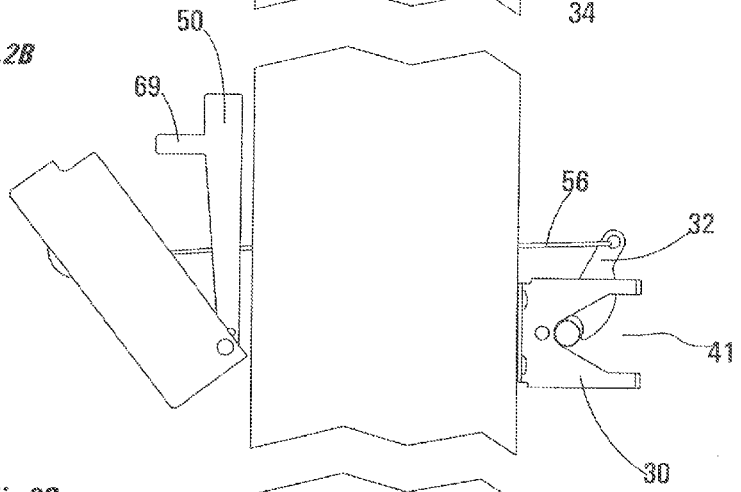
FIG. 2B is the same view as FIG. 2A, but the locking-latch apparatus is shown in an intermediate position.

As shown in FIG. 2B, the latch-frame 30 (fixed to the latch-post 21) is formed with a wide open mouth 41. The gate 23 being open, and now closing, the latch-bar 27 enters the mouth 41 of the latch-frame 30. The mouth 41 narrows to a recess 45 formed in the latch-frame 30.

Upon entering the mouth 41 of the latch-frame, the latch-bar 27 engages the sloping outer face 43 of the hook 36. As the latch-bar 27 enters further into the mouth 41, its engagement with the latch-lever 32 causes the latch-lever 32 to pivot upwards, thereby allowing the latch-bar 27 to enter the recess 45 of the latch-frame 30.

Figure 2C:
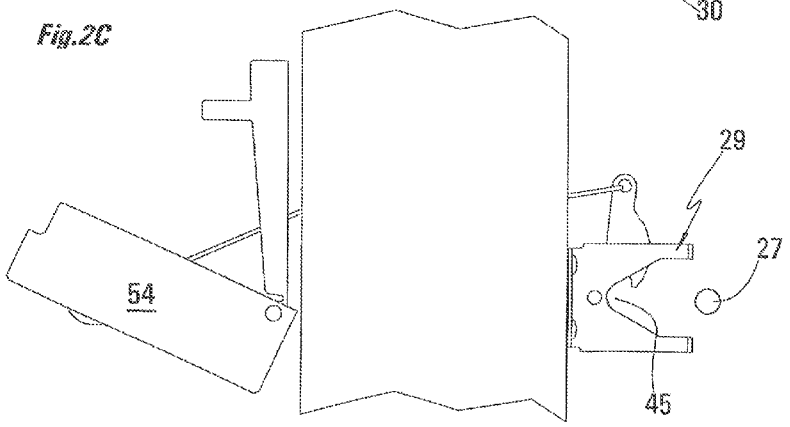
FIG. 2C is the same view as FIG. 2A, but the locking-latch apparatus is shown in its open-unlatched position.

In operation, the latch-lever 32 is pivotable between its latched-position (FIG. 2A) and its clear-position (FIG. 2C). In the latched-position (FIG. 2A), the hook 36 of the latch-lever 32 covers the recess 45 in the latch-frame 30. The gate being closed, the latch-bar 27 is present in the recess 45; the gate being open, the latch-bar 27 lies outside (i.e to the right) of the recess 45. If the latch-bar 27 is present in the recess 45, the latch-bar 27 cannot move out of the recess 45 (and the gate 23 cannot open) until the latch-lever 32 is moved to its clear-position. The latch-lever 32 can be moved to its clear-position (FIG. 2C), either by direct hand manipulation (by a person on the yard-side of the fence), or alternatively by (a person on the street-side) pulling the lock-cover 54 downwards.

When the latch-lever 32 is in its latched-position, and the latch-bar 27 is outside the recess 45, the act of closing the gate 23 causes the latch-bar 27 to strike the angled outer-face 43 of the hook 36, which drives the hook 36 upwards, and moves the latch-lever 32 to its clear-position (FIG. 2C), allowing the latch-bar 27 to enter the recess 45. When the latch-bar 27 reaches the recess 45, the latch-lever 32 drops down to its latched-position (FIG. 2A).

Now, the latch-bar 27 is retained in the recess 45 by the hook 36, whereby the gate remains closed and latched—until a person once again operates (raises) the latch-lever 32.

FIGS. 2A,2B,2C also show a lock-assembly 49, being components of the locking-latch apparatus that are located on the street-side of the latch-post 21. A lock-base 50 is secured to the latch-post 21 e.g by wood-screws. The lock-base 50 includes a lock-hinge 52. A lock-cover 54 is mounted for pivoting movement, about the lock-hinge 52, relative to the lock-base 50. The lock-cover 54 and the lock-base 50 are relatively movable in a clam-shell mode.

A cable 56 links the latch-lever 32 to the lock-cover 54. The cable 56 passes through a cable-hole 38 in the latch-post 21. As will be understood from FIGS. 2A,2B,2C, the presence of the cable 56 ensures that pivoting movement of the latch-lever 32 about the latch-pivot 34 takes place in unison with pivoting movement of the lock-cover 54 about the lock-hinge 52.

A person on the street-side of the gate 23 thus can unlatch the gate 23 by pulling down on the lock-cover 54. This action serves to move the latch-lever 32 to its FIG. 2C clear-position, whereupon the person can push the gate open.

The gate can be opened also from the yard-side. The person simply lifts the latch-lever 32, by hand manipulation, just as they would if the latch-lock apparatus were not present. The cable 56 goes slack if the lock-cover 54 remains stationary when the latch-lever 32 is raised. For this reason, the designers should see to it that, when the cable is slack, the cable 56 cannot accidentally become detached from the latch-lever 32, nor from the lock-cover 54.

Figures 3A, 3B, 3C:
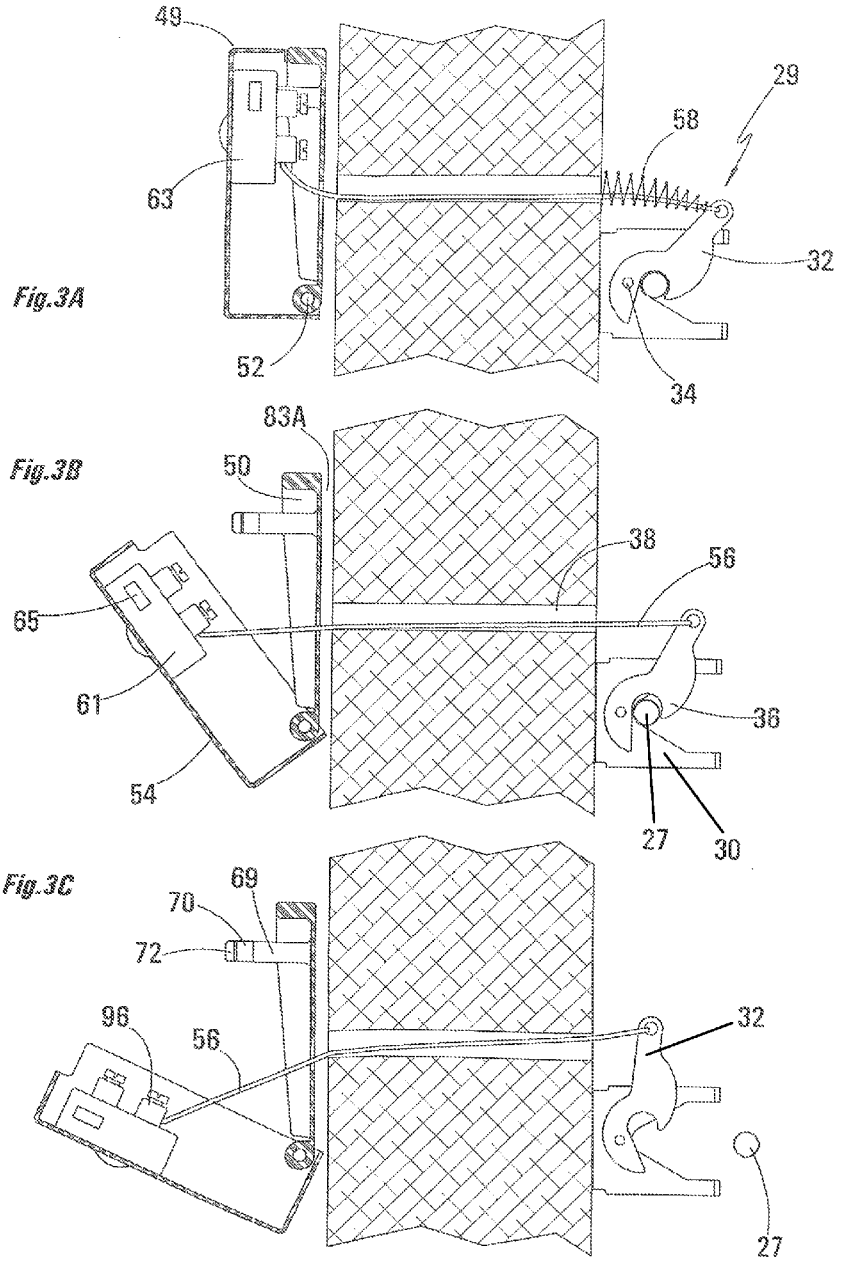
FIGS. 3A,3B,3C are the same views as FIGS. 2A,2B,2C, but show some of the components of the locking-latch apparatus in cross-section.

A latch-spring 58 is provided. (The latch-spring 58 is shown in FIGS. 2A,3A, but is omitted from the other drawings.) The latch-spring 58 urges the latch-lever 32 clockwise, i.e downwards towards its latched-position (FIG. 2A). The (compression) spring 58 reacts against the latch-post 21. The latch-lever 32, by itself, tends to return to its latched-position simply by gravity, but the presence of the cable connection between the latch-lever 32 and the lock-cover 54 means that gravity alone might not provide enough force—hence the latch-spring 58.

It may be noted that, since the latch-lever is returned by a latch-spring, rather than just by gravity, the designer now has the option to arrange for the latch-lever to pivot downwards rather than upwards, should that be desired.)

The lock-cover 54 is pivotable between a closed-position (FIG. 2A) and an open-position (FIG. 2C). In the closed-position of the lock-cover 54, the cable 56 is slack, and the latch-lever 32 remains in its latched-position. In the open-position of the lock-cover 54 (FIG. 2C), the cable 56 has pulled the latch-lever 32 to its clear-position. The lock-cover 54 can only be moved from its closed-position to its open-position if a person (outside the fence) sets the dials of the combination look to the open-combination.

In the locking-latch apparatus as depicted herein, the lock-cover 54 is lockable to the lock-base 50. When so locked, the lock-cover 54 remains in the FIG. 2A closed-position, and cannot move to the FIGS. 2B,2C positions. Thus, a person on the street-side of the gate cannot open the gate if the lock-cover 54 is looked to the lock-base 50. However, even when the lock-cover 54 is locked, a person on the yard-side can still open the gate, by operating the latch-lever 32 manually.

A person located on the street-side of the gate can only pull the lock-cover 54 down if they can unlock the lock-cover 54 from the lock-base 50—which they can only do if they know the open-combination.

The housing 61 of a lock-unit 63 is integrated into the lock-cover 54, in that the housing 61 is bolted to the inside of the lock-cover 54. The lock-unit 63 is provided with movable plungers 65, which are spring-loaded apart by a lock-spring 67.

The lock-base 50 is formed with protruding left and right arms 69. The arms 69 are integrated into the lock-base 50. The arms 69 are formed with respective notches 70. The notches 70 in the arms 69 face inwards, i.e face each other.

FIGS. 7A,7B,7C,7D show the operation of the lock-unit, in its interaction with the notches 70. The lock-cover 54 being open, and moving towards its closed position, in FIG. 7A the lock-unit 63 is approaching the arms 69 of the lock-base 50. The plungers 65 are being urged apart by the lock-spring 67, but the plungers 65 are able to move towards each other, against the lock-spring 67.

Figure 7A:
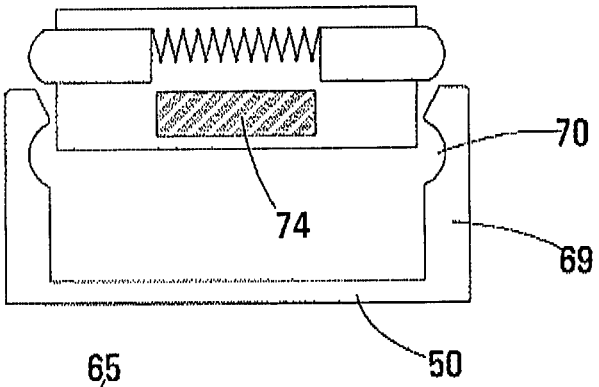
FIG. 7A is a close-up view showing plungers of the lock-unit of the lock-assembly interacting with posts of the lock-cover of the lock-assembly.
Figure 7B:
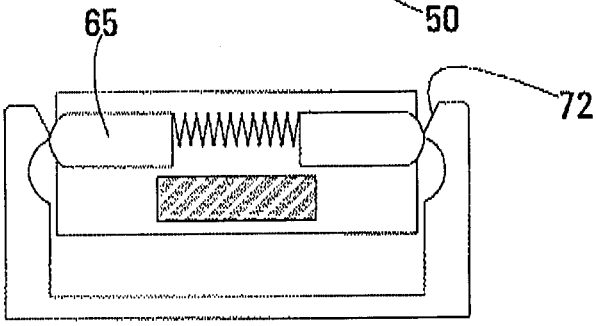
FIGS. 7B,7C,7D are the same view as FIG. 7A, but show the lock-unit and posts in different operational positions.

In FIG. 7B, the lock-cover 54 is almost closed, and the lock-unit 63 has started to interact with the arms 69. The plungers 65, having engaged lead-in chamfers 72 provided on the ends of the arms 69, have moved towards each other.

Figure 7C:
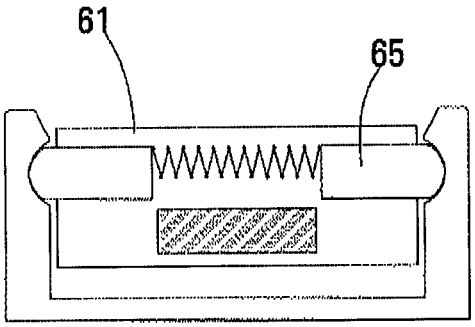

In FIG. 7C, the lock-cover is now closed with respect to the lock-base 50, and the lock-unit 63 has reached the end of its travel. The lock-spring 67 has pushed the plungers 65 apart, and now the plungers lie fully inside the notches 70. It will be understood that, if the lock-unit 63 were to move relative to the arms 69 (i.e, in FIG. 7C, to move in the up/down sense), the engagement of the plungers 65 with the notches 70 would urge the lock-unit to revert to the FIG. 7C position.

Figure 7D:
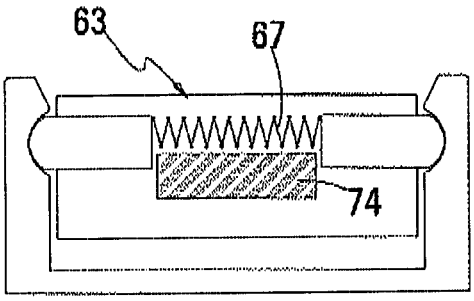

The lock-unit 63 also includes a blocker 74. In FIGS. 7A,7B,7C, the blocker 74 lies withdrawn, and does not affect the in/out movement of the plungers 65. In FIG. 7D, the blocker 74 has taken up a new position, and now lies between the plungers 65. Now, the plungers 65 cannot move towards each other, and thus the plungers cannot move out of the notches 70. With the blocker 74 in this new position, effectively the lock-cover 54 cannot be pulled away from the lock-base 50, and the gate cannot be opened from the street-side.

The blocker 74 moves between its clear-position (FIGS. 7A,7B,7C) and its lock-position (FIG. 7D) in dependence upon the setting and operation of the combination lock of the lock-unit 63. When the rotary dials of the combination lock are set to their unique open-combination, the blocker 74 lies in its clear-position; when the dials are scrambled and are set to some random combination, now the blocker 74 lies in its lock-position (FIG. 7D).

(The structure of the lock-unit 63 that enables the lock-unit to function in this manner is conventional, and is described in the said U.S. Pat. No. 7,251,967. The lock-unit 63 includes a re-set capability, whereby the open-combination can be changed. With the lock-cover 54 open, the person operates a lever 94 to activate the re-set mode. Having re-set the open-combination, the lever 94 is returned.)

The combination lock of the lock-unit 63 has four rotary dials 76. When the dials 76 are moved to the preset open-combination, the blocker 74 moves to its clear-position. The dials 76 being in any other combination, the blocker 72 remains in its lock-position.

Again, if the plungers 67 lie in the notches 70 at the time when the blocker 74 is in, or is moved into, its lock-position (FIG. 7D), the plungers 67 cannot retract, and the result is that the lock-cover 54 cannot pivot relative to the lock-base 50. The gate 23 remains closed, and cannot be opened from the street-side. The blocker 74 needs to be in its clear-position (FIGS. 7A,7B,7C) in order for the gate to be opened from the street-side.

If the plungers 67 lie clear of the notches 70 (FIG. 7A) at the time when the blacker 74 is in, or is moved into, its lock-position, the plungers 67 again cannot retract—with the result that the lock-cover 54 cannot be closed onto the lock-base 50.

Figure 4:
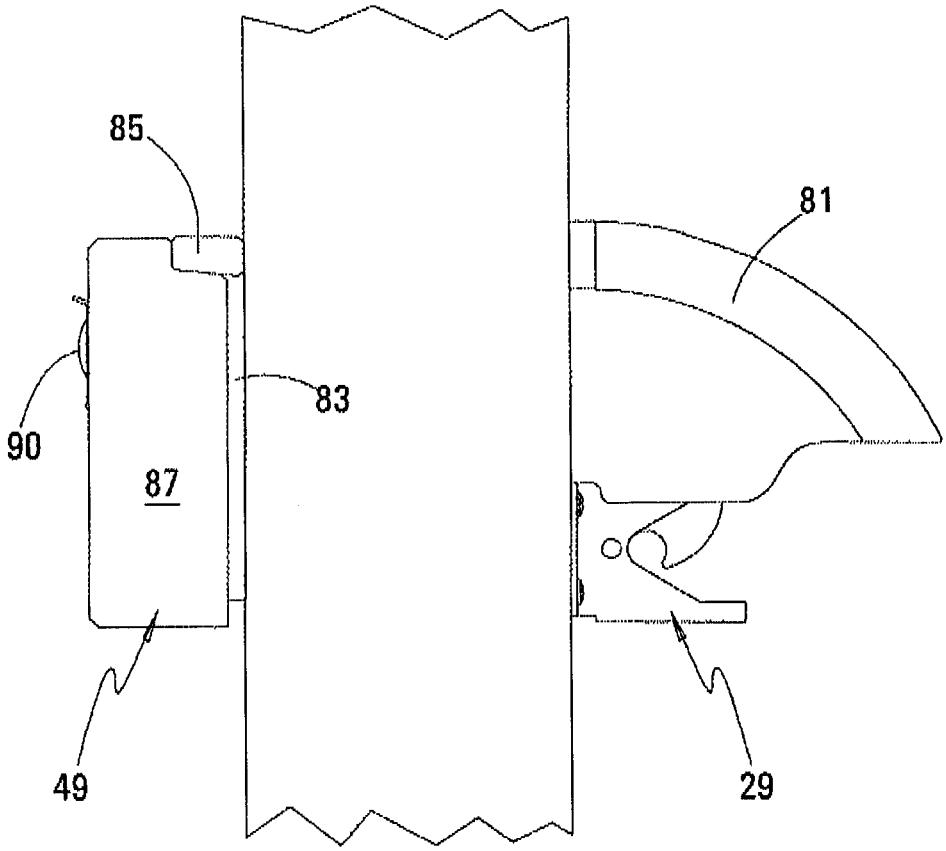
FIG. 4 is a side-elevation of the latch-gatepost, showing the locking-latch apparatus with protective shrouds in place.
Figure 5:
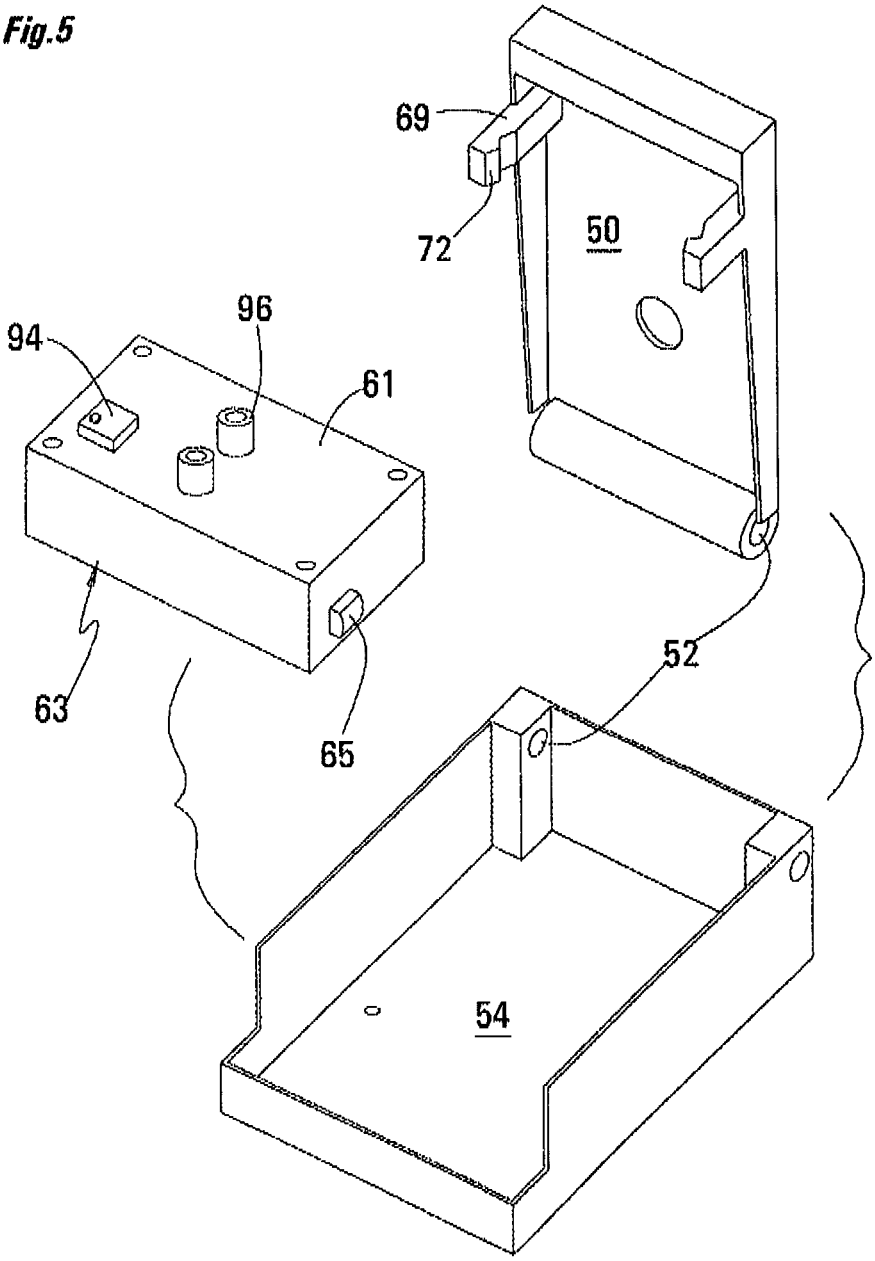
FIG. 5 shows pictorial views of some of the components of a lock-assembly of the locking-latch apparatus.
Figure 6:
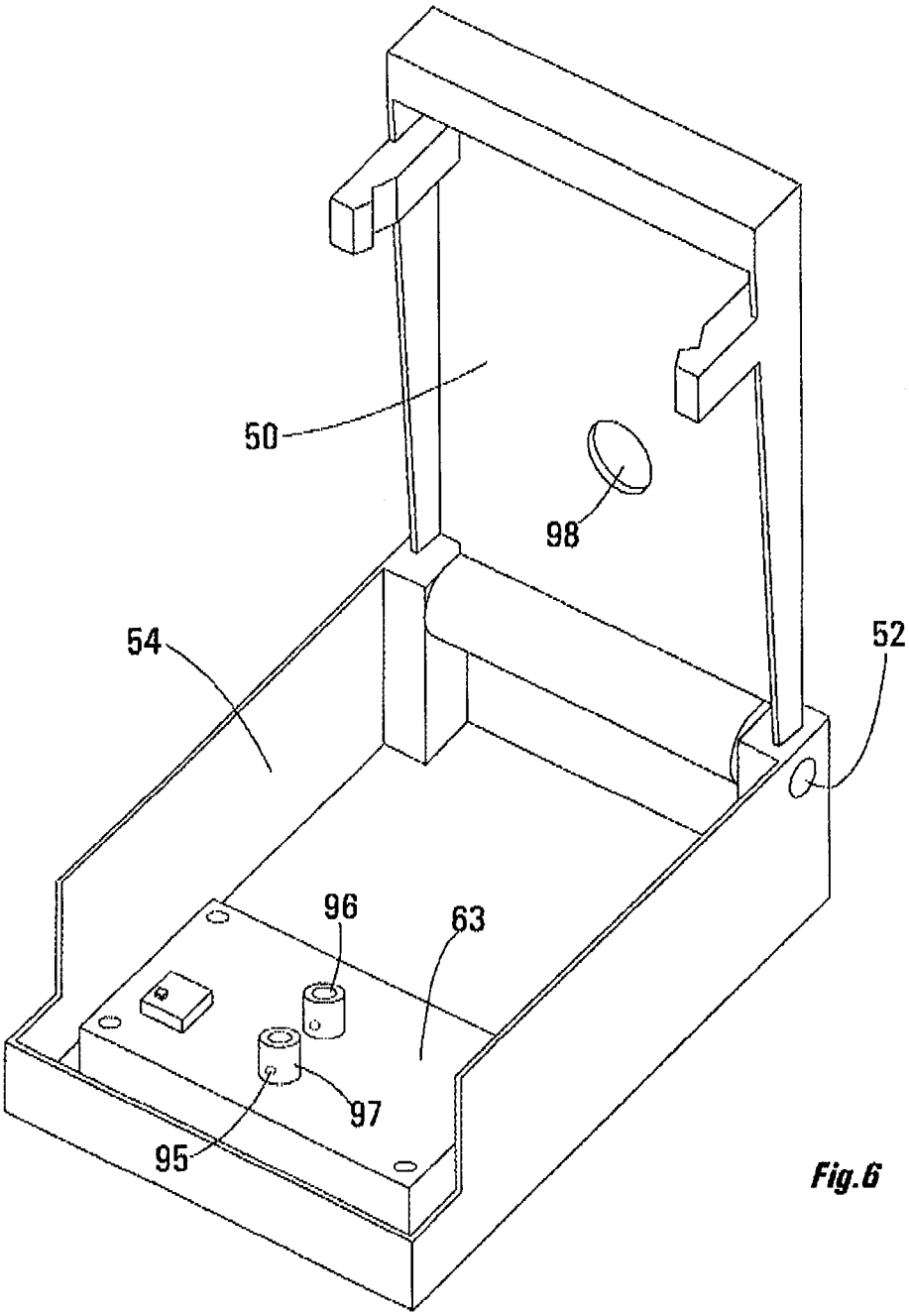
FIG. 6 shows the components of the lock-assembly of FIG. 5 now assembled together.

The components of the locking-latch apparatus are preferably protected from the weather. FIG. 4 is a side-elevation, showing, on the yard-side, a moulded plastic latch-shroud 81, which is screwed to the latch-post 21. The latch-shroud 81 provides good protection, and yet permits easy access of the person's hand, for the purposes of manipulating the latch-lever 32.

On the street-side, the lock-base 50 and the lock-cover 54 are protected by respective base- and cover-shrouds. The base-shroud 83 is made of a elastomeric material, and is sandwiched between the back of the lock-base 50 and the face of the latch-post 21. A roof 85 of the base-shroud 83 extends forwards over the top of the lock-base 50.

In FIG. 2A et al, the base-shroud 83 has been omitted, for clarity. The base-shroud 83 fits in the space 83A that is visible between the back of the lock-base 50 and face of the latch-post 21.

The cover-shroud 87 is of moulded plastic, and is configured to clip firmly onto and over the lock-cover 54, so that it remains securely attached to the lock-cover 54 during operation. When the lock-assembly 49 is closed, the upper part of the cover-shroud 87 abuts against the forward-facing edge 89 of the roof 85 of the base-shroud 83. The lock-assembly 49, thus protected by the shrouds, is—though not watertight—substantially weatherproof—which is what is needed for the application.

Figure 8:
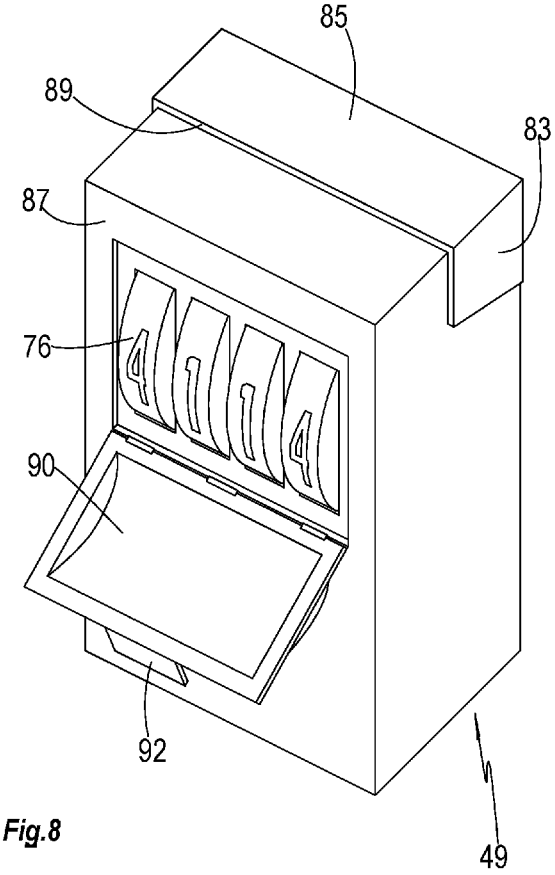
FIG. 8 is a pictorial view of the lock-assembly of the locking-latch apparatus, shown with protective shrouds in place, and showing access to the dials of the combination lock.

As shown in FIG. 8, the cover-shroud 87 includes a hinged shutter 90. A tab 92 on the shutter 90 enables a person on the street-side to open the shutter 90, and thereby to gain access to the rotary dials 76 of the combination lock.

The looking-latch apparatus as depicted herein is easy to install. First, latch-frame 30 is screwed to the yard-side of the latch-post 21, and the latch-bar 27 is screwed to the gate 23. Even an unskilled handyman finds it easy to fix these components in their correct alignment.

Then, the cable-hole 38 is drilled through the latch-post 21. The cable-hole 38 takes its position directly from the now-fixed latch-frame 30, and—again—it is very easy for an amateur handyman to get the hole 38 in the right place relative to the latch-frame 30.

Then, the look-base 50 is screwed to the street-side of the latch-post 21. Again, it is very easy to position the lock-base 50 correctly, so that the through-hole 98 in the lock-base 50 (for the cable to pass through the look-base) lies over the street-side mouth of the cable-hole 38. When installing the components of the apparatus, there are no alignment difficulties—despite the fact that some components are on the yard-side of the gate and some are on the street-side. There is also no need for measurements to be made, and for calculations to be carried out.

The latch-assembly 29 and the lock-assembly 49 being secured in place, it is an easy matter to feed the cable 56 through the cable-hole 38. (The installer should of course thread the cable 56 through the latch-spring 58 before passing the cable 56 through the cable-hole 38.) The cable 56 is threaded through the hole in the latch-lever 32, and then is looped to form an eyelet: the installer then crimps a ferrule onto the cables to form the loop. (The designers can arrange for the eyelet connection between the cable 56 and the latching-lever 32 to be done in-factory.)

The installer enters the other and of the cable 56 into the post-hole 95 of the cable-fixing-post 96 on the housing 61 of the lock-unit 63, and then tightens the post-screw. The installer should take care that there is a little slack in the cable 56 when the lock-cover 54 is closed, to ensure that the latch-lever 32 can fully latch—the condition shown in FIG. 2A.

A second cable-fixing-post 97 is provided, as shown. It is possible that the cable might work loose if only one post were provided. The second cable-fixing-post 97 provides extra security in case the first post-screw might work loose.

The second post 97 also provides a convenient way to tuck the loose tail of the cable out of the way. Particularly if the latch-post 21 happens to be on the thin side, the unused tail of cable, after the cable has been fed through the post-hole 95, can be quite long; the installer would not wish to be set the task of trimming off the excess cable length, so it is preferred to accommodate the loose tail inside the lock-cover. However, if the tail were to be just stuffed into the hollow of the lock-cover, the (long) tail might tend to burst out when the lock-cover is opened—which would be most tiresome. To control the tail of the cable, the cable preferably is passed through both posts 96,97 in series, so as to create a bridge of cable between the two posts. (The post-holes 95 should not be so close to the surface of the housing 61 as to prevent this.) Then, the tail of the cable is passed under the bridge. When this is done, the tail is well-controlled; also, the loop thereby formed provides yet more security against pull-through, if the post screws should tend to work loose.

A person who knows the open-combination can operate the locking-latch apparatus in the following manner. Upon approaching the gate from the street-side, the person opens the shutter 90, and manipulates the rotary dials 76 such that the open-combination is visible. That being done, the blocker 74 moves to its clear-position. That being done, the person now pulls the lock-cover 54 downwards. This action makes the cable 56 pull the latch-lever 32 upwards, releasing the latch-bar 27, and the person can now push open the gate 23.

Before walking through the open gate, however, the person should first close the lock-cover 54 to the lock-base 50, and should then scramble the dials to a random combination. Then, the person walks through the gate. Once in the yard, the person pushes the gate closed, causing the latch-bar 27 to latch into the latch-frame 30 in the traditional way.

The gate 23 being closed and latched, the gate now, once again, cannot be opened from the street-side, except by a person who knows the open-combination. The gate can be unlatched and opened from the yard-side by anyone. (If it is desired e.g to prevent a small child from opening the gate from the yard-side, the latch-assembly 29 should be high enough off the ground that the child cannot reach it. The locking latch assembly as depicted herein is not intended to be child-proof, other, than by being placed out of the child's reach. Again, knowledge of the open-combination is not required in order for a person to unlatch and open the gate from the yard-side.)

When a person opens the gate from the yard-side, and passes through the gate from the yard-side to the street side, it is not necessary for the person to touch any of the components of the lock-assembly 49. The (untouched) dials 76 remain sot to the last-entered random combination.

Again, in order to open the gate from the street-side, the person performs these actions: (i) he opens the shutter 90 and rotates the dials 76 to the open-combination; (ii) he pulls down the lock-cover 54, and eases the gate open; (iii) he releases the lock-cover 54; (iv) he scrambles the dials 76; (v) he closes the shutter 90; and (vi) having walked though the gate, he then pushes the gate closed. It will be understood that the person can accomplish this sequence of operations, with one hand.

The lock-unit 63 is not self-locking. When the gate is being closed, the plungers 65, if they are able to move inwards, do move inwards in response to being urged to do so by riding up the lead-in chamfers 72 of the arms 69. If an attempt is made to close the gate when the combination is scrambled, in that case the plungers 65 cannot retract and cannot enter the notches 70. This is advantageous, in that the lock-assembly 49 thus is resistant to being inadvertently set at some unknown combination.

The connecting link between the lock-cover and the latch-lever preferably is a flexible cable, rather than a rigid rod or bar. A rigid rod would be disadvantageous because when the person pushes on the latch-lever from the yard-side of the door, a rigid rod would prevent the latch-lever from moving in the direction to unlatch the latch-bolt, and special provisions would have to be made to enable the gate to be unlatched from the yard-side. Another disadvantage of a rigid rod is that, because of the arcuate pivoting movements of the latch-lever and the cover, the angle of the connecting link changes as the components move. Thus, using a rigid link, if the connecting hole is to permit the required full range of movement of the link, the connecting hole would have to be considerably larger, to accommodate the arcuate movements of the latch-lever and the lock-cover. But a flexible cable accommodates itself to required bends and turns, thereby permitting the cable-hole to be small, as shown.

Figure 9:
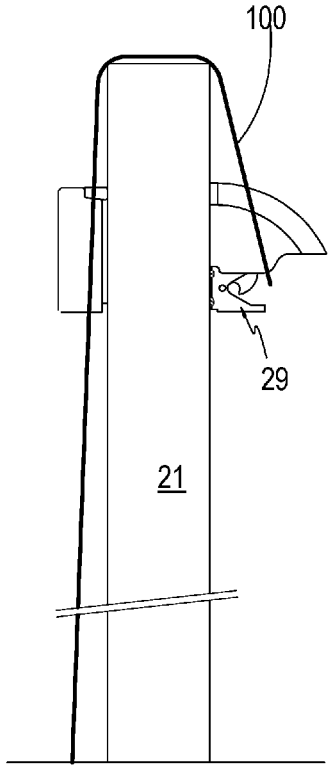
FIG. 9 illustrates a way of determining whether the gate or fence is high enough to deter reach-over.

As mentioned, the locking latch assembly depicted herein is not secure against miscreants who are prepared to climb over the gate or fence. It is also not secure against miscreants who, upon reaching over the top of the gate or fence, can then reach the latch-assembly 29, and can manipulate the latch-lever 32 and thereby open the gate. To offer good protection against reach-over, the gate and fence should be tall, and the latch-assembly should be at a suitable height on the latch-post. Consider a piece of string 100 which extends from the ground on the street-side of the gate, passes over the gate, and extends down to the latch-assembly on the yard-side (see FIG. 9). This piece of string 100 should be a minimum of two meters in length, to give good protection against reach-over.

Regarding reach-over, it may be noted that the presence of the latch-shroud 81 provides protection against a person attempting to manipulate the latch-lever 32 by reaching over the gate. At the same time, the shape of the latch-shroud 81 is such as to provide almost no hindrance to access by a family-member seeking to manipulate the latch-lever, and to open the gate, from the yard-side.

When the lock-cover 54 is closed against the lock-base 50, a locked receptacle is created inside the clamshell configuration of the lock-assembly 49, which can contain a small article. This locked receptacle can be useful when, for example, it is desired to leave e.g a small article in a secure place, on the street, awaiting pick-up.

The scope of the patent protection sought herein is defined by the accompanying claims. The apparatuses and procedures depicted in the accompanying drawings and described herein are examples.

The numerals used in the drawings are listed as:

20 fence
21 latch-post
23 gate/door
25 hinge-post
27 latch-bar
29 latch-assembly
30 latch-frame
32 latch-lever
34 latch-pivot
36 hook
38 cable-hole (in latch-post 21)
41 mouth (of latch-frame 30)
43 sloping outer-face (of hook 36)
45 recess (of latch-frame 30)
49 lock-assembly
50 lock-base
52 lock-hinge
54 lock-cover
56 cable
58 latch-spring
61 housing (of lock-unit 63)
63 lock-unit
65 movable plungers
67 lock-spring
69 arms (protrusions from lock-base 50)
70 notches (in arms 69)
72 lead-in chamfers
74 blocker (of the lock-unit 63)
76 rotary dials
81 latch-shroud

83 base-shroud
83A space (representing base-shroud)
85 roof (of base-shroud 83)
87 cover-shroud
89 forward edge of roof 85
90 hinged shutter (on cover-shroud 87)
92 tab (on shutter 90)
94 combination-change lever (on lock-unit 63)
95 post-hole (in cable fixing post)
96 cable-fixing-post
97 2nd cable-fixing-post
98 though-hole (in lock-base 50)
100 measuring string The latch-lever 32 moves between its latched-position and its clear-position.

The lock-cover 54 moves between its closed-position and its open-position.

The blocker 74 moves between its clear-position and its block-position.

The invention claimed is:

1. Locking-latch apparatus for locking a gate in a fence;
the gate being hinged to a hinge-post, and being latched to a latch-post;
the latch-post being formed with a through-aperture, through from a street-side to a yard-side of the latch-post;
wherein:
the apparatus includes a latch-assembly and a lock-assembly;
the latch-assembly includes a movable element and a fixed element;
the fixed element of the latch-assembly is fixable to the yard-side of the latch-post;
the movable element of the latch-assembly is mounted on the fixed element for movement relative thereto;
the lock-assembly includes a movable element and a fixed element;
the fixed element of the lock-assembly is fixable to the street-side of the latch-post;
the movable element of the lock-assembly is mounted on the fixed element of the lock-assembly for movement relative thereto;
the apparatus includes a link, which is so structured that it can be passed through the through-aperture in the latch-post;
the link couples the movable element of the latch-assembly to the movable element of the lock-assembly, the link being so structured as to constrain the two movable elements to move together;
the apparatus includes a lock, which is so structured as to be operable, responsively to manipulation by a person, between a locked-condition and an unlocked-condition;
in its locked condition, the lock is effective to block the movable element of the lock-assembly from opening relative to the lock-base;
in its unlocked condition, the lock is effective to permit the movable element of the lock-assembly to open relative to the lock-base;
the apparatus is so structured that a person on the street-side of the fence, having unlocked the lock, can move the movable element of the lock-assembly, which moves the movable element of the latch-assembly to unlatch the gate, and thereby permits the person to push open the gate; wherein
a lock-cover serves as the movable element of the lock-assembly, and a lock-base serves as the fixed element;
the lock-cover is hinged to the lock-base, about a lock-hinge;
a latch-lever serves as the movable element of the latch-assembly, and a latch-frame serves as the fixed element;
the latch-lever is pivoted to the latch-frame, about a latch-pivot;
a cable serves as the link, and connects the latch-lever to the lock-cover; and
the link is so structured that rotating the lock-cover about the lock hinge is effective to rotate the latch-lever about the latch-pivot.

2. As in claim 1, wherein the lock-cover, the lock-base, and the lock-hinge, are so arranged that:
the apparatus being mounted to the latch-post, the axis of the hinge-pivot is horizontal;
the lock being unlocked, the lock-cover can open and close in a clamshell mode;
and the lock-cover, in moving from closed to open, rotates downwards and away from the latch-post.

3. As in claim 1, wherein the apparatus includes a latch-spring, which is effective to bias the latch-lever to its latched-position.

4. As in claim 1, wherein:
the lock is contained in a lock-unit;
the lock-unit includes a housing from which protrudes a movable plunger;
the housing of the lock-unit is fixed to the lock-cover;
the lock-unit is so structured that:
(a) the lock-unit being unlocked, the plunger is retractable into the housing against a lock-spring; and
(b) the lock-unit being locked, the plunger is blocked from retracting into the housing;
the lock-base is provided with a post, having a notch;
the lock-assembly is so configured that, when the lock-cover is closed onto the lock-base, the plunger enters the notch;
whereby, when the lock-unit is locked, the plunger is blocked from leaving the notch, and the lock-cover remains locked to the lock-base until the lock-unit is unlocked.

5. As in claim 1, wherein:
the apparatus includes a lock-base-shroud;
the lock-base-shroud is configured to fit between the lock-base and the street-side of the latch-post, and to be fixed in that position when the lock-base is fixed to the latch-post;
the lock-assembly is so configured that, when the lock-cover and the lock-base are closed together, a top edge of the lock-cover abuts a top edge of the lock-base, at a top-interface;
the lock-base-shroud includes a roof, which, when the lock-cover and the lock-base are closed together, overlies this interface.

6. As in claim 5, wherein:
the apparatus includes a lock-cover-shroud;
the lock-cover-shroud is configured to fit over the lock-cover, and to move with the lock-cover when the lock-cover moves;
the lock-assembly is so configured that, when the lock-cover and the lock-base are closed together, an edge of the lock-cover-shroud abuts a forward edge of the roof of the lock-base-shroud.

7. As in claim 1, wherein:
the lock is a combination lock, having rotary dials;
the apparatus includes a lock-cover-shroud, which is configured to fit over the lock-cover, and to move with the lock-cover when the lock-cover moves;

the lock-cover-shroud includes a shutter, which is movable between open and closed positions;

the shutter being closed, the shutter overlies and closes off a window in the lock-cover-shroud;

the shutter being open, the shutter lies clear of the window, through which the rotary dials are visible, and are accessible for manipulation.

8. As in claim 1, wherein the lock-assembly includes two spaced cable-fixing posts, so positioned that the cable can be fixed to the two posts, in series.

9. As in claim 8, wherein:

the lock is contained in a lock-unit, which includes a housing;

the cable is fixed to the lock-cover indirectly, in that the cable-fixing posts are integrated into the housing of the lock-unit, and the lock-unit is fixed to the lock-cover.

10. As in claim 1, wherein:

the apparatus includes a latch-shroud, which is fixed to the latch-post, and is so configured as:

(a) to overlie the latch-assembly; and (b) to leave room for access whereby a person on the yard-side of the gate can manipulate the latch-lever.

11. As in claim 1, wherein:

the locking-latch apparatus includes the fence and the gate;

the apparatus is so sized and configured that a piece of string extending from ground level on the street-side of the gate, up over the gate or fence, and down the yard-side of the gate or fence to the latch-assembly, would be at least two meters in length.

* * * * *